United States Patent [19]

Kimura

[11] Patent Number: 4,538,137

[45] Date of Patent: Aug. 27, 1985

[54] FIRE DETECTOR

[75] Inventor: Tetsuo Kimura, Tokyo, Japan

[73] Assignee: Nittan Company, Limited, Tokyo, Japan

[21] Appl. No.: 444,475

[22] Filed: Jan. 20, 1983

[51] Int. Cl.[3] ..... G08B 29/00; G08B 17/06

[52] U.S. Cl. ..... 340/512; 340/530; 340/628; 340/595; 328/6

[58] Field of Search ..... 340/512, 513, 514, 500, 340/506, 507, 510, 511, 526, 530, 595, 628, 593; 307/116, 97, 132 R, 152; 328/6

[56] References Cited

U.S. PATENT DOCUMENTS

| | | | |
|---|---|---|---|
| 3,657,713 | 4/1972 | Sasaki et al. | 340/514 |
| 3,665,461 | 5/1972 | Gnagi et al. | 340/512 |
| 3,717,862 | 2/1973 | Sasaki | 340/514 |
| 3,979,740 | 9/1976 | Forbat et al. | 340/512 |

FOREIGN PATENT DOCUMENTS

| | | | |
|---|---|---|---|
| 2095881 | 10/1982 | United Kingdom | 340/512 |

*Primary Examiner*—Donnie L. Crosland

*Attorney, Agent, or Firm*—Abelman Frayne Rezac & Schwab

[57] ABSTRACT

In a fire detector that includes a sensor for producing an output voltage corresponding to smoke concentration, temperature, etc., there is provided a charge-and-discharge circuit to be reset by the turning ON of a switching circuit which is made ON at a fixed voltage. The output of the charge-and-discharge circuit and the output of a sensor are applied to the switching circuit to vary the ON period of the switching circuit corresponding to the output voltage of the sensor. Any irregularity in the sensor can be monitored by changes in the ON period.

9 Claims, 14 Drawing Figures

Fig. 7(a)
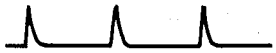
Fig. 7(b)
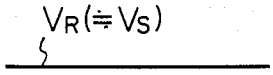
Fig. 7(c)
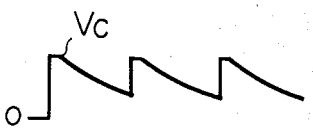
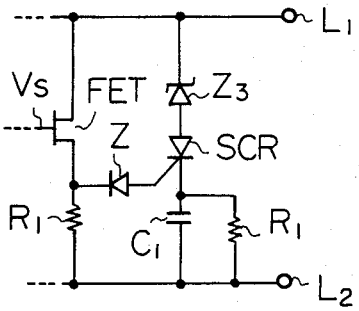
Fig. 8
Fig. 9
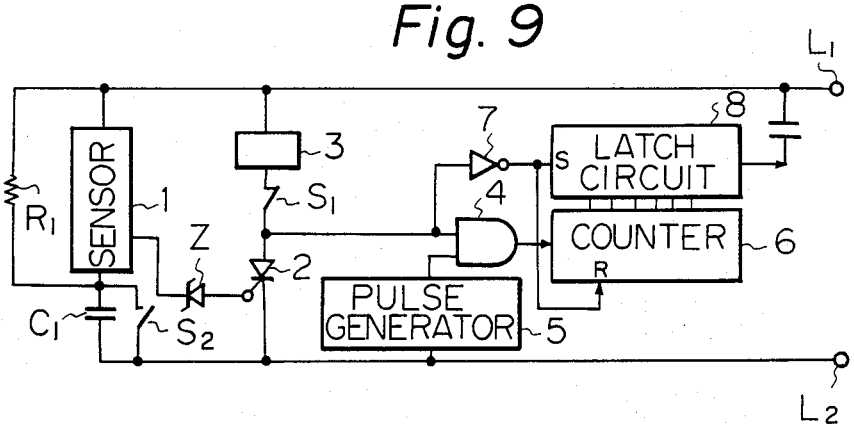

FIRE DETECTOR

TECHNICAL FIELD OF THE INVENTION

This invention relates to an improvement in the fire detector.

BACKGROUND OF THE INVENTION

The conventional fire detector simply detects occurrence of a fire by means of a sensor which senses smoke concentration and/or temperature change and outputs a voltage, the switching circuit of the detector being turned ON when the voltage exceeds or falls below a fixed value. An element with self-holding function, such as a thyristor, is generally used as the switching circuit of a fire detector.

In testing the conventional fire detector, the operator has to introduce smoke into the fire sensor or to raise temperature thereof in order to learn whether the sensor is operating normally or whether the set voltage for operating the switching circuit is normal. An alternative method for testing the operation of the fire sensor is known, in which an equivalent voltage is applied to the sensor instead of actual introduction of smoke, actual temperature rise, etc. Even in this case, however, the operator must go to the place where the fire sensor is installed and the test itself is complicated. The need for going to such trouble and for such complicated testing is recognized as a defect of the conventional fire detector. Another defect is that the conventional fire detector operates by a comparison of the output voltage of the sensor with a fixed value and, therefore, the operation is merely binary, that is, ON or OFF, and degree or variation in smoke concentration and in temperature rise cannot be known. A method has also been known in which the output voltage of a sensor is sent out after conversion into a digital value, but in such a case the sensor unit must be provided independently of the digital converting unit so that the overall apparatus is complicated and expensive.

Accordingly, the object of this invention is to provide a fire detector which can be checkable for normal operation from a remote location and which can ascertain change and variation in parameters, such as smoke concentration and temperature, etc., in real time, thus eliminating the defects of the prior art fire detectors.

DISCLOSURE OF THE INVENTION

This invention provides a fire detector comprising a sensor for producing an output voltage corresponding to smoke concentration, temperature, etc., and a switching circuit to be turned ON when the output voltage of the sensor exceeds or falls below a fixed value, wherein a charge-and-discharge circuit is provided to be operated by power supplied through a pair of alarm lines and to be reset by the turning ON of the switching circuit, and the output of the charge-and-discharge circuit is connected with the sensor in series between the alarm lines.

This invention further provides a fire detector comprising a switching circuit which is made ON by a control voltage exceeding a fixed value and a charge-and-discharge circuit for starting a charge and discharge operation in response to the ON state of the switching circuit wherein the switching circuit turns ON in response to a difference between the output voltage of the charge-and-discharge circuit and the output voltage of the sensor.

This construction eliminates the defect that it takes a long duration before the output of a sensor becomes stable due to the time constant of the sensor when the output of the charge and discharge circuit is serially connected to the sensor, if the sensor has a high impedance.

This invention further provides a pulse oscillator to count the number of pulses during an ON state of the switching circuit and to send out the content of the count to the alarm lines so that the fire parameters can be ascertained from moment to moment using a transmission technique of conventional time sharing.

BRIEF DESCRIPTION OF THE DRAWINGS

This invention will now be described in detail with reference to the accompanying drawings, in which:

FIG. 8 is a partial circuit diagram showing a fifth embodiment of this invention, and FIG. 9 is a circuit diagram showing a sixth embodiment of this invention.

DETAILED DESCRIPTION OF THE EMBODIMENTS

Figure 1:
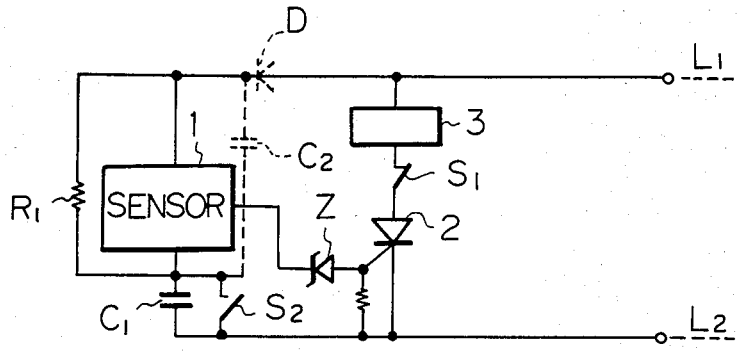
FIG. 1 is a circuit diagram showing an embodiment of this invention.

In FIG. 1, a sensor 1, an ionic smoke sensor, for instance a photodiode which receives scattered light or a heat sensitive element, generates an output voltage corresponding to the smoke concentration, temperature, etc. A Zener diode Z conducts when the output voltage of the sensor 1 exceeds a fixed value and makes the gate terminal of a thyristor 2 high level to turn the thyristor ON. A serially connected circuit consisting of a capacitor $C_1$ and a resistor $R_1$ is connected between a pair of alarm lines $L_1$ and $L_2$ and the capacitor $C_1$ is charged gradually by the voltage from the alarm lines. The sensor 1 is connected between the alarm line $L_1$ and one terminal of the capacitor $C_1$. More particularly, the sensor 1 and the capacitor $C_1$ are connected in series between the two alarm lines and the voltage charged on the capacitor $C_1$ is applied to the negative side of the sensor 1. A charge-and-discharge circuit is constructed by the capacitor $C_1$, the resistor $R_1$ and a normally-open contact $S_2$ of a relay 3 and the voltage on the capacitor $C_1$ is the output voltage of the charge-and-discharge circuit. The cathode electrode of the thyristor 2 is connected to the alarm line $L_2$ and the anode electrode of the thyristor 2 is connected to the alarm line $L_1$ through a normally-closed contact $S_1$ of the relay 3. The normally-open contact $S_2$ is connected across the capacitor $C_1$. The normally-open contact $S_2$ closes and the normally-closed contact $S_1$ opens upon the operation of the relay 3. A current sensing circuit may be provided in place of the relay 3 and the normally-closed contact $S_1$ and the normally-open contact $S_2$ may be controlled by the current sensing circuit. In this case, the contacts $S_1$ and $S_2$ may each be constituted of a transistor.

The operation of the circuit shown in FIG. 1 is as follows. The capacitor $C_1$ is charged by the voltage from the alarm lines $L_1$ and $L_2$ through the resistor $R_1$ and the voltage on the terminal of the capacitor $C_1$ increases gradually. When the sum of the voltage charged on the capacitor $C_1$ and the output voltage of the sensor 1 exceeds a fixed value, the Zener diode Z conducts to trigger the thyristor 2. When the thyristor 2 turns ON the relay 3 operates to close the normally-open contact $S_2$ and the voltage charged on the capacitor $C_1$ discharged. In other words, the charge-and-discharge circuit is reset and the Zener diode Z turns OFF. While, when the normally-closed contact $S_1$ is opened, the thyristor 2 turns OFF and the relay 3 is restored to the original state. The normally-closed contact $S_1$ is closed by the restoration of the relay 3 and the thyristor 2 remains OFF since the Zener diode Z has already turned OFF. While, since the normally-open contact $S_2$ is opened by the restoration of the relay 3, the capacitor $C_1$ is again charged through the resistor $R_1$ and the operation stated above is repeated. In other words, the thyristor 2 is turned ON and OFF at a fixed period. The period varies normally according to the output voltage of the sensor 1. More particularly, for example, the period becomes shorter with a larger output voltage of the sensor 1 and becomes longer with a smaller output voltage of the sensor 1. At an extreme condition, if the sensor should fault and no output voltage is obtained, the Zener diode Z does not contact so that the thyristor 2 does not turn ON. Accordingly, it is possible to check the abnormality of the sensor 1 by monitoring the ON period of the thyristor 2 from the other end of the alarm lines $L_1$ and $L_2$.

When the output voltage of the sensor 1 changes, for example, with generation of smoke upon the occurrence of a fire the ON period of the thyristor 2 changes according to the degree of change in the output voltage. The ON period becomes shorter when the change in the output voltage of the sensor 1 adds to the charge voltage of the capacitor 1 and becomes longer when the change is subtracted from the charge voltage. Therefore, any type of smoke sensor can be used and the sensor 1 may be a temperature sensor.

As will be understood from the above explained operation, the relay 3 may desirably have some restore-delay characteristics so that complete discharge of the capacitor $C_1$ and turning OFF of the thyristor 2 are assured. One terminal of the sensor 1 may be connected to the alarm line $L_1$ through the normally-closed contact $S_1$ instead of being directly connected to the alarm line $L_1$. A diode D for prevention of reverse current and a capacitor $C_2$ may desirably be connected to the alarm line $L_1$, as shown by broken lines in FIG. 1, in order to prevent the voltage on the sensor 1 from changing precipitantly when the thyristor 2 turns ON. These modifications can appropriately be made according to the characteristics of the sensor 1 or other conditions.

Figure 2:
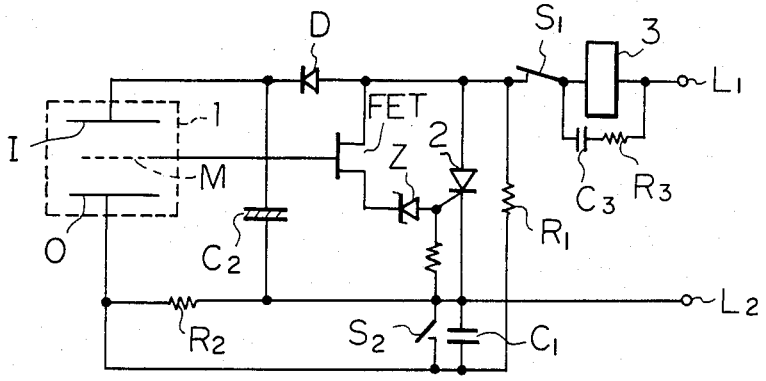
FIG. 2 is a circuit diagram showing a specific example of the circuit when this invention is applied to an ionic smoke sensor.

FIG. 2 shows a specific example of the circuit employed when the sensor 1 is an ionizing smoke sensor. The output of the ionic smoke sensor 1 is of high impedance and, therefore, the intermediate electrode M of the ionic smoke sensor 1 is connected to the gate terminal of a field effect transistor FET so that an impedance conversion is effected. The source electrode of the field effect transistor FET is connected to a Zener diode Z and the drain electrode of the field effect transistor FET is connected to an alarm line $L_1$ through a normally-closed contact $S_1$ and a relay 3. The voltage supplied from the alarm lines $L_1$ and $L_2$ charges a capacitor $C_2$ through a diode D, and the charged voltage of the capacitor $C_2$ is applied to the inner electrode I of the smoke sensor and the outer electrode O of the sensor 1, the charged voltage being applied to the outer electrode through a resistor $R_2$. The other end of the Zener diode Z is connected to the gate electrode of a thyristor 2, and the anode of the thyristor 2 is connected to the alarm line $L_1$ through the normally-closed contact $S_1$, while the cathode electrode of the thyristor 2 is connected to the alarm line $L_2$. Therefore the power for operating the sensor 1 is supplied by the voltage charged on the capacitor 2 even when the thyristor is ON. A capacitor $C_1$ is charged through the normally-closed contact $S_1$ and a resistor $R_1$ and the voltage charged on the capacitor $C_1$ is applied to the outer electrode of the sensor 1. Thus, the voltage on the gate terminal of the field effect transistor FET is the sum of the voltage charged on the capacitor $C_1$ and the voltage existing between the intermediate electrode M and the outer electrode of the sensor 1. A normally-open contact $S_2$ is connected in parallel to the capacitor $C_1$, and a serial circuit of a resistor $R_3$ and a capacitor $C_3$ is connected in parallel with the relay 3 which has delayed restoring characteristics.

The operation of the circuit shown in FIG. 2 is as follows. The capacitor $C_2$ is charged with the voltage supplied from the alarm lines $L_1$ and $L_2$ through the reverse flow prevention diode D, and a voltage (a sensed voltage) is present between the intermediate electrode M and the outer electrode O of the sensor 1, said voltage corresponding to a voltage such as an inter-electrode impedance voltage when no smoke exists. Said voltage is applied to the Zener diode Z after undergoing impedance conversion by the field effect transistor FET and the Zener diode Z is kept OFF by the voltage in the absence of smoke. On the other hand, the capacitor $C_1$ is gradually charged through the resistor $R_1$ and the voltage on the outer electrode O of the sensor 1 increases with the increase in the voltage charging the capacitor $C_1$. The voltage on the gate terminal of the field effect transistor FET is the sum of the voltage charged on the capacitor $C_1$ and the voltage sensed by the sensor 1. The summed-up voltage is applied to the Zener diode Z after undergoing impedance conversion and then the Zener diode Z conducts to turn the thyristor 2 ON when the voltage on the capacitor $C_1$ becomes a fixed value. After the thyristor turns ON, the relay 3 operates to close the normally-open contact $S_2$ and the potential on the outer electrode of the sensor 1 drops to turn the Zener diode OFF. On the contrary, the normally-closed contact $S_1$ turns OFF and the thyristor 2 turns OFF. When the relay 3 restores with some delay, the normally-closed contact $S_1$ closes and the normally-open contact $S_2$ opens, whereafter the above operation is repeated. In other words, the thyristor 2 turns ON at a fixed period. The period is constant if the output voltage of the sensor 1 is constant under the no smoke condition. But the period varies with change in the output voltage of the sensor 1 due to insufficient insulation even under the no smoke condition. Accordingly, normal operation and abnormal operation of the sensor 1 can be distinguished by monitoring the ON period of the thyristor 2 in the ordinary state.

The output voltage of the sensor 1 increases according to the smoke concentration when a fire occurs, and thus the thyristor 2 turns ON at a lower voltage charged on the capacitor $C_1$. In other words, the ON period of the thyristor 2 becomes shorter. The reduction in the period corresponds to the smoke concentration, so that the smoke concentration can be learned by measuring the period. If the connection of the inner electrode and the outer electrode of the sensor 1 is reversed, the period becomes longer with greater smoke concentration and the smoke concentration can be known in this case as well.

Figure 3:
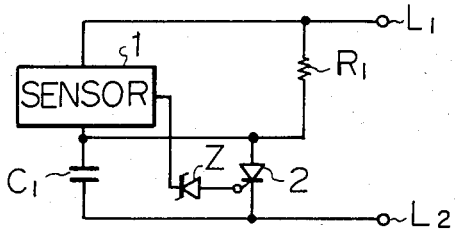
FIG. 3 is a circuit diagram showing another embodiment of this invention.

In FIG. 3, a serial circuit consisting of a sensor 1 and a capacitor $C_1$ is connected between the alarm lines $L_1$ and $L_2$ and is charged through a resistor $R_1$ by the alarm line $L_1$. More particularly, a charge-and-discharge circuit is formed by the resistor $R_1$ and the capacitor $C_1$, and the capacitor $C_1$ for producing an output voltage of the charge and discharge circuit is connected serially to the sensor 1. The output voltage of the sensor 1 is applied to the gate electrode of a thyristor 2 through a Zener diode Z. A switching circuit which turns ON at a fixed voltage is formed by the Zener diode Z and the thyristor 2. The anode electrode of the thyristor 2 is connected to the junction of the capacitor $C_1$ and the resistor $R_1$ and the cathode electrode of the thyristor 2 is connected to the alarm line $L_2$. Accordingly, when the thyristor 2 turns ON, the charge-and-discharge circuit is reset by the discharge of the capacitor $C_1$. After the capacitor $C_1$ discharges completely, the thyristor 2 turns OFF because of the lack of holding current and the capacitor $C_1$ starts again to be charged. In this embodiment, the relay 3 and the normally-closed contact $S_1$ as shown in FIG. 1 are omitted, and the thyristor 2 which acts as a switching circuit serves as the normally-open contact $S_2$. The circuit of the embodiment shown in FIG. 3 is extremely simple and can achieve an effect similar to the effect of the embodiment shown in FIG. 1 by an operation similar to the operation stated above.

Figure 4:
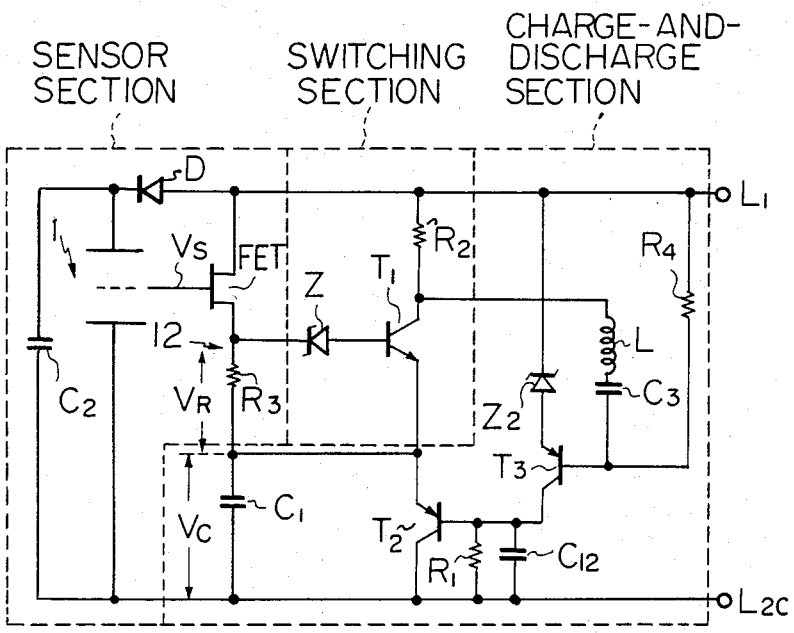
FIG. 4 is a circuit diagram showing a third embodiment of this invention, FIGS. 5(*a*)–5(*d*) show the waveforms of voltages at various parts of the circuit shown in FIG. 4.
Figure 5A:
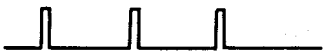
Figure 5B:
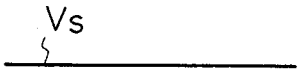
Figure 5C:
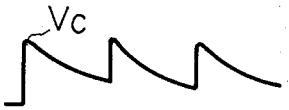
Figure 5D:
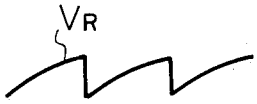

In FIG. 4, is shown the circuit diagram of an embodiment of the fire detector characterized in that a switching circuit is turned ON by the difference in the output voltage of a charge-and-discharge circuit and the output voltage of a sensor. In the embodiment, an ionic smoke sensor is employed but other types of sensors, such as a photoelectric smoke sensor or a temperature sensor, can also be applied. In FIG. 4, positive and negative voltage is supplied to an alarm line $L_1$ and a common line $L_{2c}$ from a receiving unit, not shown in the figure. A capacitor $C_2$ is charged from the alarm line $L_1$ through a reverse flow prevention diode D and the voltage charged on the capacitor $C_2$ is applied between the inner electrode and the outer electrode of an ionic smoke sensor 1. An intermediate electrode is located between the inner electrode and the outer electrode and the voltage of the intermediate electrode varies according to smoke concentration. The output of the sensor appearing on the intermediate electrode is applied to an impedance transducer 12 to be converted to a low impedance as the inner impedance is very high. An impedance transducer 12 is, in this embodiment, exemplified as a field effect transistor FET, etc. and the output voltage of the sensor 1 applied to the gate electrode of the field effect transistor FET is taken out as a voltage which is nearly equal to the applied voltage from a source electrode of the field effect transistor FET. The source electrode is connected to the common line $L_{2c}$ through a resistor $R_3$ and a capacitor $C_1$. The output voltage of the source electrode is applied to one end of a Zener diode Z and the other end of the Zener diode Z is connected to the base electrode of a transistor $T_1$. The collector electrode of the transistor $T_1$ is connected to the alarm line $L_1$ through a resistor $R_2$ and the emitter electrode of the transistor $T_1$ is connected to the junction of the resistor $R_3$ and the capacitor $C_1$. Thus, when the voltage across the resistor $R_3$ exceeds a fixed voltage, the Zener diode Z conducts and the transistor $T_1$ turns ON. In other words, in this embodiment, a switching circuit that turns ON at a fixed voltage is formed by the Zener diode Z and the transistor $T_1$. The emitter electrode and the collector electrode of a transistor $T_2$ are connected across the capacitor $C_1$ and the base electrode of the transistor $T_2$ is connected to the collector electrode of a transistor $T_3$. A parallel circuit consisting of a resistor $R_1$ and a capacitor $C_{12}$ is connected between the base electrode of the transistor $T_2$ and the common line $L_{2c}$. The emitter electrode of the transistor $T_3$ is connected to the alarm line $L_1$ through a Zener diode $Z_2$ and the base electrode of the transistor $T_3$ is connected to the collector electrode of the transistor $T_1$ through a capacitor $C_3$ and an inductance L. The base electrode of the transistor $T_3$ is also connected to the alarm line $L_1$ through a resistor $R_4$. Thus, the charge-and-discharge circuit formed by the transistors $T_2$ and $T_3$, the capacitors $C_1$ and $C_{12}$ and the resistors $R_1$ and $R_4$, etc. starts the charge-and-discharge operation when the transistor $T_1$ turns ON.

The operation of the circuit shown in FIG. 4 is explained in reference to FIG. 5. The Zener voltage of the Zener diode Z is so selected that the transistor $T_1$ is ON when the voltage on the capacitor $C_1$ is 0 under the condition where no smoke is present. Accordingly, the transistor $T_1$ turns ON first and the transistor $T_3$ turns ON next. By the turning ON of the transistor $T_3$, the capacitor $C_{12}$ is charged to a fixed voltage through the Zener diode $Z_2$, the voltage on the emitter electrode of the transistor $T_2$ increases, the transistor $T_1$ turns OFF and the transistor $T_3$ turns OFF successively. That is to say, the transistor $T_1$ is ON for a short time and waveforms of pulses as shown in FIG. 5(*a*) appear across the resistor $R_2$. As an output voltage $V_s$ of the sensor in the absence of smoke as shown in FIG. 5(*b*) is applied to the gate electrode of the field effect transistor FET, the potential of the source electrode of the field effect transistor FET is nearly equal to the output voltage $V_s$. Accordingly, the voltage $V_R$ across the resistor $R_3$ is expressed by the following equation:

$$V_R \approx V_s - V_c$$

wherein $V_c$ is the voltage of the capacitor $C_1$. In other words, the voltage $V_R$ takes a fixed minimum value when the capacitor $C_1$ is charged to a fixed value. The transistor $T_1$ is then OFF.

Next, when the transistor $T_3$ turns OFF the charge on the capacitor $C_{12}$ discharges through the resistor $R_1$ and the voltage on the base electrode of the transistor $T_2$ decreases gradually due to the time constant determined by the capacitor $C_{12}$ and the resistor $R_1$, and accordingly the voltage $V_c$, that is the voltage on the emitter electrode of the transistor $T_2$, decreases as shown in FIG. 5(*c*). The voltage $V_c$ on the capacitor $C_1$ is the output voltage of the charge-and-discharge circuit. With the decrease of the voltage $V_c$ of the capacitor $C_1$, the voltage across the resistor $R_3$ increases as shown in FIG. 5(*d*) and the transistor $T_1$ turns ON when the voltage $V_R$ reaches a fixed Zener voltage. In this embodiment, as the voltage $V_c$ does not affect the output voltage $V_s$ of the sensor 1, the operation of the sensor is stable (While, when the voltage $V_c$ is applied between the sensor 1 and the common line $L_{2c}$, the change in the voltage $V_c$ does affect the output voltage of the sensor 1 and it takes a long time before the sensor 1 reaches a stable state). Accordingly, the sensor 1 operates stably even with a shorter charge and discharge period of the capacitor. As the charge and discharge circuit repeats the charge and discharge at a period similar to the period stated above with the turning ON of the transistor $T_1$, the transistor $T_1$ turns periodically ON. Accordingly, a pulse train with a fixed period appears across the resistor $R_2$ as shown in FIG. 5(*a*). The period of the pulse train becomes shorter with a larger output voltage $V_s$ of the sensor 1 and becomes longer with a smaller output. Thus, any degradation of the sensor 1 due to such a factor as deteriorating insulation can be sensed by monitoring of the pulse period.

When the output voltage of the sensor 1 rises, for example, due to the occurrence of a fire, the period of the pulse train becomes shorter and as the smoke concentration increases, the output voltage of the sensor 1 rises and the period of the pulse train accordingly becomes shorter. This means that the smoke concentration can be distinguished by measuring the period of the pulse train. If a sensor such that the output voltage drops as the smoke concentration increases, is used, the period of the pulse train, on the contrary, becomes longer with increasing concentration. Thus the smoke concentration can be known in this case as well. Accordingly, the fire detector of this invention can be applied to any kind of sensor. As changes in the output voltage of a sensor due to defective insulation or the influence of ambient temperature occur very slowly, the changes can be easily distinguished from a change due to the occurrence of a fire by monitoring of the changes per unit time. Not only the intensity of a fire, but also how it spreads and how it is being extinguished can be determined by monitoring of the period of the pulse train in time series before and after the fire occurrence. Therefore, proper measures for extinguishing the fire can be taken in accordance with the situation.

Figure 6:
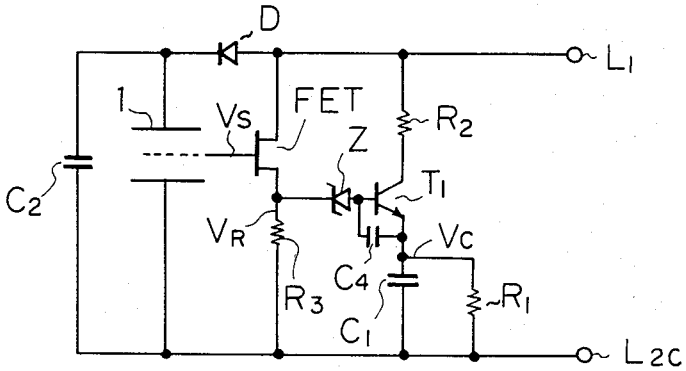
FIG. 6 is a circuit diagram showing a fourth embodiment of this invention, FIGS. 7(*a*)–7(*c*) show the waveforms of voltages at various parts of the circuit shown in FIG. 6.

In FIG. 6, a resistor $R_3$ is connected between the source electrode of a field effect transistor FET and a common line $L_{2c}$ and the emitter electrode of a transistor $T_1$ is connected to the common line $L_{2c}$ through a parallel circit consisting of a resistor $R_1$ and a capacitor $C_1$. The collector electrode of the transistor $T_1$ is connected to an alarm line $L_1$ through a resistor $R_2$. A sensor 1, a reverse flow prevention diode D, a capacitor $C_1$, etc. are connected similarly to the cases of the preceding figures. A Zener diode Z is connected between the source electrode of the field effect transistor FET and the base electrode of the transistor $T_1$. A capacitor $C_4$ is connected between the base electrode and the emitter electrode of the transistor $T_1$.

The operation of the circuit shown in FIG. 6 is as follows: The voltage $V_R$ across the resistor $R_3$ is nearly equal to the output voltage $V_s$ of the sensor 1 in the absence of smoke. So the Zener diode Z is made to conduct by the output voltage $V_s$ to turn ON the transistor $T_1$ and the capacitor $C_1$ is charged to the fixed voltage which has been divided by the resistors $R_2$ and $R_1$. When the voltage on the emitter electrode of the transistor $T_1$ rises due to the charge on the capacitor $C_1$, the Zener diode Z turns OFF while the transistor $T_1$ maintains the ON state for a short duration due to the discharge of the capacitor $C_4$ to complete the charging of the capacitor $C_1$. The pulse waveforms appearing across the resistor $R_2$ are shown in FIG. 7(*a*). The discharge of the capacitor $C_4$ stops and the transistor $T_1$ turns OFF. The charge on the capacitor $C_1$ is then discharged through the resistor $R_1$ and the voltage $V_c$ on the capacitor $C_1$ drops according to the time constant $C_1R_1$ as shown in FIG. 7(*c*). The voltage $V_R$ appearing across the resistor $R_3$ is maintained at a fixed value which is nearly equal to the voltage $V_s$, as shown in FIG. 7(*c*). Accordingly, when the voltage $V_c$ of the capacitor $C_1$ drops and the voltage $V_R - V_c$ reaches the Zener voltage, the Zener diode Z conducts and the transistor $T_1$ turns ON to charge the capacitor $C_1$ to a fixed voltage. A pulse train as shown in FIG. 7(*a*) appears across the resistor $R_2$ when the operation stated above is repeated. The period of the pulse train becomes shorter as the time required for the voltage $V_R - V_c$ to exceed the Zener voltage is shorter when the output voltage $V_s$ of the sensor 1 is high, and therefore the voltage $V_R$ across the resistor $R_3$ is high. And the period becomes longer when the output voltage $V_s$ of the sensor 1 is lower. Accordingly, any disorder in the output voltage due to an insulation defect in the sensor 1 can be checked by monitoring the period of the pulse train. Any change in the smoke concentration when a fire occurs can be learned from changes in the period of the pulse train as well. Thus, the circuit shown in FIG. 6 has an effect similar to that obtained in the preceding embodiment.

In FIG. 8, a Zener diode $Z_3$ is used in place of the resistor $R_2$ shown in FIG. 6 and a thyristor SCR in place of the transistor $T_1$. The output of the Zener diode Z is connected to the gate electrode of the thyristor SCR. When a voltage $V_R$ which is nearly equal to the output voltage $V_s$ of the sensor is applied to the Zener diode Z and the thyristor SCR turns ON, the capacitor $C_1$ is charged up to a fixed voltage through the Zener diode $Z_3$. The thyristor SCR is kept in the ON state by the charging current even if the potential on the cathode electrode of the thyristor SCR rises during the charging cycle. The thyristor SCR turns OFF when the capacitor $C_1$ is charged to the fixed voltage and no charging current flows. As the charge on the capacitor $C_1$, then discharges through the resistor $R_1$ and the output voltage $V_c$ of the capacitor $C_1$ drops gradually to a point where the voltage difference $V_s - V_c$ reaches the Zener voltage, the thyristor SCR turns ON again and the operation stated above is repeated. In other words, the thyristor SCR turns ON at a constant period in the same way as the operation of the circuit shown in FIG. 6 to attain an affect similar to that in the preceding case.

As stated above, the switching circuit is constructed to be turned ON or OFF in accordance with the difference between the output voltage of the fire sensor and the output voltage of the charge-and-discharge circuit which is charged and discharged at a fixed time constant and, therefore, the ON period of the switching circuit varies corresponding to the output voltage of the sensor. Accordingly, any disorder of the sensor and the smoke concentration can be learned by monitoring or by measuring the period. The output voltage of the charge-and-discharge circuit does not exert any influence on the operation voltage of the sensor. Therefore, differently from the prior art, a long time is not required before the operation of the sensor becomes stable after a test voltage is applied. In other words, quick checking and measurement is possible.

In FIG. 9, is shown the circuit of a further improved fire detector in accordance with this invention. The preceding embodiment is characterized in that the ON period of the switching circuit is varied in correspondence to the output voltage of the fire sensor. In the embodiment, shown in FIG. 9, there are provided one circuit for counting the number of oscillation pulses from a pulse generator 5 during the OFF period of the switching circuit, thus the output voltage of the sensor is digitized, counts of the counting circuit being applied to the alarm line, and another circuit for sending the output information of the sensor out to a receiver, not shown in the figure. The output information of a plurality of fire sensors can be simultaneously monitored. The operation of the embodiment shown in FIG. 1 in which the above circuits are added is explained below. But it will be understood that these circuits can naturally be applied to the other embodiments, too. In FIG. 9, a serial circuit consisting of a sensor 1 and a capacitor $C_1$ is connected between alarm lines $L_1$ and $L_2$, a resistor $R_1$ for charging the capacitor $C_1$ is connected between one end of the capacitor $C_1$ and the alarm line $L_1$ and a normally-open contact $S_2$ is connected across the capacitor $C_1$. The output voltage of the sensor 1 is applied to the gate electrode of a thyristor 2 through a Zener diode Z, the anode electrode of the thyristor 2 is connected to the alarm line $L_1$ through a normally-closed contact $S_1$ and a relay 3, and the cathode electrode of the thyristor 2 is connected directly to the alarm line $L_2$ (common line). The anode electrode of the thyristor 2 is connected to one terminal of an AND gate 4, and a pulse train of a fixed period is applied to the other terminal of the AND gate 4 from a pulse oscillator 5. With this arrangement, the AND gate 4 is opened only during the OFF periods of the thyristor 2 and output pulses of the oscillator 5 are applied to a counter 6. The counter 6 counts input pulses. The anode electrode of the thyristor 2 is further connected to the strobe terminal of a latch circuit 8 and the reset terminal of the counter 6 through an inverter 7. The counter 6 is reset when the thyristor 2 turns ON and, thereafter, counts the output pulses of the oscillator 5. The count of the counter 6 is latched in the latch circuit 8 when the thyristor 2 turns ON next and, therefore, the count corresponds to the ON period of the thyristor 2. In other words, the count corresponds to the output of the sensor 1. When the counter 6 is reset, it begins to count again the pulses in the next period. If the reset pulse of the counter 6 is set to be delayed relative to the reset pulse of the latch circuit 8, the contents in the latch circuit 8 will, without fail, reflect the contents in the counter 6.

If the latch circuit 8 simultaneously constitutes a shift register, the shift register can send out the contents stored in the latch circuit 8 to the alarm lines $L_1$ and $L_2$ in succession and thus the output of the sensor can be learned at the other end (the receiving unit side) of the alarm lines by receiving the count. In this situation, the information can be transferred in a short period of time and, therefore, signals can be sent out in the time sharing fashion from a plurality of sensors so that the sensors can be connected to one pair of alarm lines.

It is a known method, although not shown in FIG. 9, that each sensor's own address information is sent out in addition to the count so that there is no interference among the sent-out data when a plurality of sensors are connected. In addition, the sensors are controlled at the receiving unit side or the sensor side so that the sensors do not send out data simultaneously.

MERITS OF THE INVENTION

As has been described above, in this invention, a charge-and-discharge circuit is provided which is reset by the turning ON of a switching circuit that turns ON at a fixed voltage, and the output of the charge-and-discharge circuit and the output of the sensor are input to the switching circuit, and the switching circuit is arranged to have its ON period vary in correspondence to the output voltage of a sensor. Any irregularity in the sensor can accordingly be monitored by changes in the ON period of the switching circuit. In other words, remote monitoring can easily be conducted. Further, the period varies with change in smoke concentration, etc. and, therefore, smoke concentration, etc. can be learned by measurement of the period or by count of the number of pulses during the period, etc. More particularly, it is possible to learn the extent and progress of a fire so that the operator has a broad understanding of the situation on which he can base his judgment regarding appropriate countermeasures.

In this invention, further, as the output voltage of the charge-and-discharge circuit does not exert any influence on the operation voltage of the sensor, it does not take a long time before the sensor operation becomes stable after a test voltage is applied to the sensor, as often encountered in the prior art. This means that quick check and measurement are possible.

I claim:

1. A fire detector designed for connection between a pair of electrical alarm lines, comprising:

a sensor producing an output voltage which corresponds to a magnitude of a condition of interest, such as smoke concentration, air temperature and the like;

a charge reservoir connected between said pair of alarm lines and being charged by current flowing through them; and a switching circuit connected to the sensor and the charge reservoir and turning on and off to respectively discharge and charge the charge reservoir, the switching circuit turning on as a function of said output voltage and voltage across the charge reservoir, whereby the charge reservoir is repeatedly charged and discharged with a period determined by said output voltage.

2. The fire detector of claim 1, wherein the switching circuit is turned on when the sum of said output voltage and said voltage across the charge reservoir reaches a predetermined value.

3. The fire detector of claim 1, wherein the switching circuit is turned on when the difference between said output voltage and said voltage across the charge reservoir reaches a predetermined voltage.

4. The fire detector of claim 1, wherein the charge reservoir comprises a capacitor and a resistor which form an RC circuit that is connected across said lines.

5. The fire detector of claim 4, wherein the switching circuit comprises means for shortcircuiting said capacitor and thereby discharging it when the switching circuit is turned on.

6. The fire detector of claim 1, wherein the switching circuit comprises a Zener diode which becomes conductive when said function reaches a predetermined value.

7. The fire detector of claim 1, further comprising means for sending a signal representing said period through said alarm lines.

8. A fire detector designed for connection between a pair of electrical alarm lines, comprising:

a sensor producing an output voltage which corresponds to a magnitude of a condition of interest, such as smoke concentration, air temperature and the like;

a charge reservoir connected between said pair of alarm lines and being charged by current flowing through them;

a switching circuit connected to the sensor and the charge reservoir and turning on and off to respectively discharge and charge the charge reservoir, the switching circuit turning on as a function of said output voltage and voltage across the charge reservoir; and means for determining how long the switching circuit is on and off.

9. The fire detector of claim 8, wherein the determining means comprises:

an oscillator producing a train of constant frequency pulses;

a gate connected to the oscillator and passing pulses to an output when said switching circuit is off; and a counter counting pulses appearing at said output and connected across said alarm lines, whereby contents of the counter are sent through said lines.

* * * * *